US009982885B2

(12) United States Patent
Taylor et al.

(10) Patent No.: US 9,982,885 B2
(45) Date of Patent: May 29, 2018

(54) BURNER WITH COMBUSTION AIR DRIVEN JET PUMP

(71) Applicant: Honeywell International Inc., Morristown, NJ (US)

(72) Inventors: Curtis L. Taylor, Gaston, IN (US); Joseph S. F. Goh, Noblesville, IN (US); Brad Patterson, Dunkirk, IN (US); Marek Scholler, Unicov (CZ)

(73) Assignee: Honeywell International Inc., Morris Plains, NJ (US)

( * ) Notice: Subject to any disclaimer, the term of this patent is extended or adjusted under 35 U.S.C. 154(b) by 204 days.

(21) Appl. No.: 14/741,219

(22) Filed: Jun. 16, 2015

(65) Prior Publication Data

US 2016/0370002 A1 Dec. 22, 2016

(51) Int. Cl.

| | |
|---|---|
| ***F23C 9/06*** | (2006.01) |
| ***F23C 7/06*** | (2006.01) |
| ***F23J 15/00*** | (2006.01) |
| ***F23D 14/64*** | (2006.01) |

(52) U.S. Cl.

CPC ..... *F23C 9/06* (2013.01); *F23C 7/06* (2013.01); *F23D 14/64* (2013.01); *F23J 15/00* (2013.01); *F23C 2201/101* (2013.01); *F23C 2202/30* (2013.01); *F23C 2900/09002* (2013.01)

(58) Field of Classification Search

CPC ..... F23C 7/06; F27J 15/00
USPC ..... 431/8, 2, 115; 110/202, 206, 263, 340
See application file for complete search history.

(56) References Cited

U.S. PATENT DOCUMENTS

| | | | | |
|---|---|---|---|---|
| 3,927,958 | A | 12/1975 | Quinn | |
| 4,130,388 | A * | 12/1978 | Flanagan | F23C 7/02 431/10 |
| 4,445,842 | A | 5/1984 | Syska | |
| 5,195,884 | A * | 3/1993 | Schwartz | F23C 6/047 431/116 |
| 5,269,679 | A | 12/1993 | Syska et al. | |
| 5,292,244 | A * | 3/1994 | Xiong | B01F 5/0451 239/414 |
| 5,473,881 | A | 12/1995 | Kramnik et al. | |
| 5,636,977 | A | 6/1997 | Benson et al. | |

(Continued)

FOREIGN PATENT DOCUMENTS

KR 20010009896 A 2/2001

OTHER PUBLICATIONS

Ho Keun Kim, et al. "No reduction in 0.03-0.2 MW oxy-fuel combustor using flue gas recirculation technology". The Combustion Institute 31 (2007). pp. 3377-3384. Accessed from: http://www.journals.elsevier.com/proceedings-of-the-combustion-institute.

(Continued)

*Primary Examiner* — Gregory Huson
*Assistant Examiner* — Nikhil Mashruwala
(74) *Attorney, Agent, or Firm* — Brooks, Cameron & Huebsch, PLLC

(57) ABSTRACT

Devices, methods, and systems for utilizing a burner with a combustion air driven jet pump are described herein. One burner apparatus includes a jet pump located inside a burner housing, the jet pump having a combustion air inlet that receives combustion air, a chamber to receive the combustion air from the combustion air inlet, and a tapered portion of the chamber that tapers to an outlet having a smaller diameter than the diameter of the inlet.

18 Claims, 2 Drawing Sheets

(56) References Cited

U.S. PATENT DOCUMENTS

| | | | | |
|---|---|---|---|---|
| 6,106,276 | A * | 8/2000 | Sams | F23D 14/46 126/110 C |
| 6,383,461 | B1 | 5/2002 | Lang | |
| 6,383,462 | B1 * | 5/2002 | Lang | F23C 9/08 110/345 |
| 6,638,059 | B1 * | 10/2003 | Mougey | F04F 5/466 431/202 |
| 7,967,600 | B2 * | 6/2011 | Hong | F23L 7/005 431/202 |
| 8,408,896 | B2 * | 4/2013 | Ponzi | F23D 14/08 126/116 R |
| 9,739,481 | B2 * | 8/2017 | Lang | F23D 14/08 |
| 9,749,483 | B2 * | 8/2017 | Ii | H04N 1/00389 |
| 2004/0175323 | A1 | 9/2004 | Franz et al. | |
| 2011/0223551 | A1 * | 9/2011 | Super | F23D 14/64 431/354 |
| 2016/0025366 | A1 * | 1/2016 | Snow | G05B 15/02 700/276 |
| 2016/0370002 | A1 * | 12/2016 | Taylor | F23C 9/06 |

OTHER PUBLICATIONS

International Search Report and Written Opinion from related PCT Application No. PCT/US2016/035689, dated Aug. 24, 2016, 10 pages.

* cited by examiner

BURNER WITH COMBUSTION AIR DRIVEN JET PUMP

TECHNICAL FIELD

The present disclosure relates to devices, methods, and systems utilizing a burner with a combustion air driven jet pump.

BACKGROUND

Oxides of nitrogen in the form of Nitrogen Oxide (i.e., NO) and Nitrogen Dioxide ($NO_2$) (oxides of nitrogen can generally be referred to as: NOx) are generated by the burning of fossil fuels. Along with NOx from vehicles, NOx from fossil fuel fired industrial and commercial heating equipment (e.g., furnaces, ovens, etc.) is a major contributor to poor air quality and smog.

Flue gas recycling is an industry accepted way to achieve low NOx emissions in fossil fuel fired combustion applications. Numerous field and laboratory studies have proven the beneficial effect of recycling flue gas using a variety of fossil fuel burner-sealed fired chamber test arrangements. However, the addition of flue gas recycling to any fired application requires increased equipment complexity, capital, and/or operational expense.

One method to achieve flue gas recycling using premixed burners (using a combustion air and fuel gas mixture), is to have the flue gas ducted back to a point near the combustion air intake where it can enter the combustion air fan to be mixed with the combustion air and fuel gas. This method requires additional piping and apparatus around the burner and boiler (or other sealed fired chamber).

It also requires an enlargement or upsizing of the combustion air fan to handle the increased volume of the added flue gas. Larger fans have increased cost and use more electricity per unit of heat produced. Further, these fans can become fouled due to the hot, corrosive flue gas and require the use of higher cost alloy materials, and/or additional cleaning and maintenance to keep the fan operational.

Another method, applicable to non-premixed burners, is to use an auxiliary fan to suction flue gas from the exhaust stack or fired chamber, and discharge that flue gas into the burner housing where it mixes with the incoming combustion air provided by the combustion air fan. This method requires additional flue gas piping and an additional corrosion resistant, high temperature rated fan to transport the hot flue gas.

DETAILED DESCRIPTION

Figure 1:
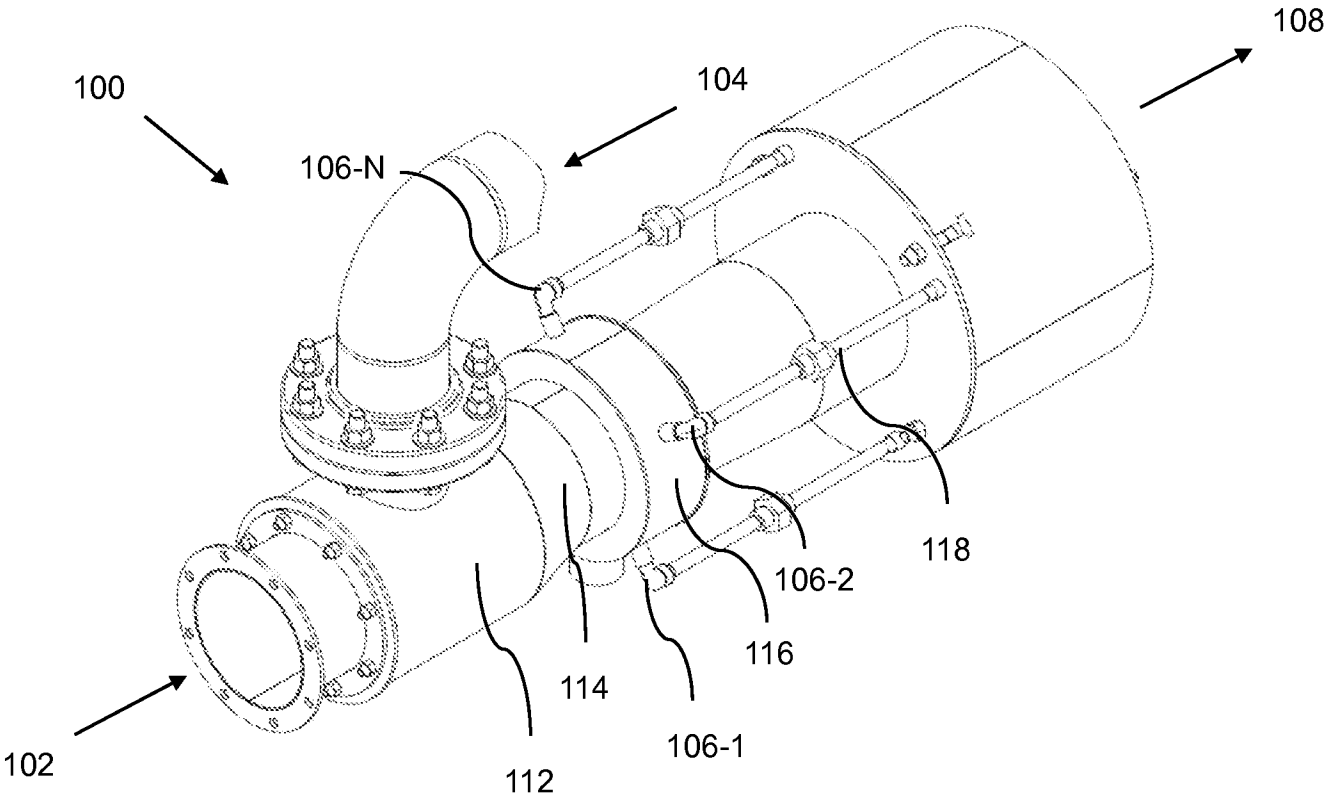
FIG. 1 is an angled overhead view of a burner with a combustion air driven jet pump according to one or more embodiments of the present disclosure.

Apparatuses, methods, and systems for utilizing a burner with a combustion air driven jet pump are described herein. One burner apparatus includes a jet pump located inside a burner housing, the jet pump having a jet pump inlet that is connected to a combustion air fan, the combustion air fan provides a volume of combustion air and combustion air pressure sufficient to drive the jet pump.

Such a jet pump arrangement can provide a negative pressure to pull flue gas from the flue gas inlet to be mixed with a combustion air and fuel gas mixture. Such an arrangement allows introduction of flue gas without having to increase piping or provide additional or upgrade fan components to either the flue gas path or the combustion air path as will be discussed in more detail below.

In the following detailed description, reference is made to the accompanying drawings that form a part hereof. The drawings show by way of illustration how one or more embodiments of the disclosure may be practiced.

These embodiments are described in sufficient detail to enable those of ordinary skill in the art to practice one or more embodiments of this disclosure. It is to be understood that other embodiments may be utilized and that process changes may be made without departing from the scope of the present disclosure.

As will be appreciated, elements shown in the various embodiments herein can be added, exchanged, combined, and/or eliminated so as to provide a number of additional embodiments of the present disclosure. The proportion and the relative scale of the elements provided in the figures are intended to illustrate the embodiments of the present disclosure, and should not be taken in a limiting sense.

The figures herein follow a numbering convention in which the first digit or digits correspond to the drawing figure number and the remaining digits identify an element or component in the drawing. Similar elements or components between different figures may be identified by the use of similar digits.

FIG. 1 is an angled overhead view of a burner with a combustion air driven jet pump according to one or more embodiments of the present disclosure. In the embodiment of FIG. 1, the burner apparatus 100 includes a combustion air inlet 102. Combustion air is air received from outside the apparatus for use in the combustion process (e.g., ambient air).

Flue gas is also received through a flue gas inlet 104, for example, from the exhaust stack and/or firing chamber. The flue gas enters the burner apparatus via the inlet and progresses into a flue gas receiving chamber 112.

The flue gas and combustion air are mixed in a narrowing portion of the chamber 114 used to convey the fluids (e.g., flue gas, combustion air). Fuel is also added into the chamber at fuel gas manifold 116 through a number of fuel ports 206-1, 206-2, 206-N.

The fuel and flue gas-combustion air mixture are mixed to form a fuel-flue gas-combustion air mixture in a mixing portion of the chamber 118. The mixture is ignited and the flame and resultant flue gas exits the chamber at outlet 108.

The embodiments of the present disclosure could be constructed, for example, of rolled and formed sheet metal, tubing, and/or pipe. In various embodiments, other suitable materials can be used.

Figure 2:
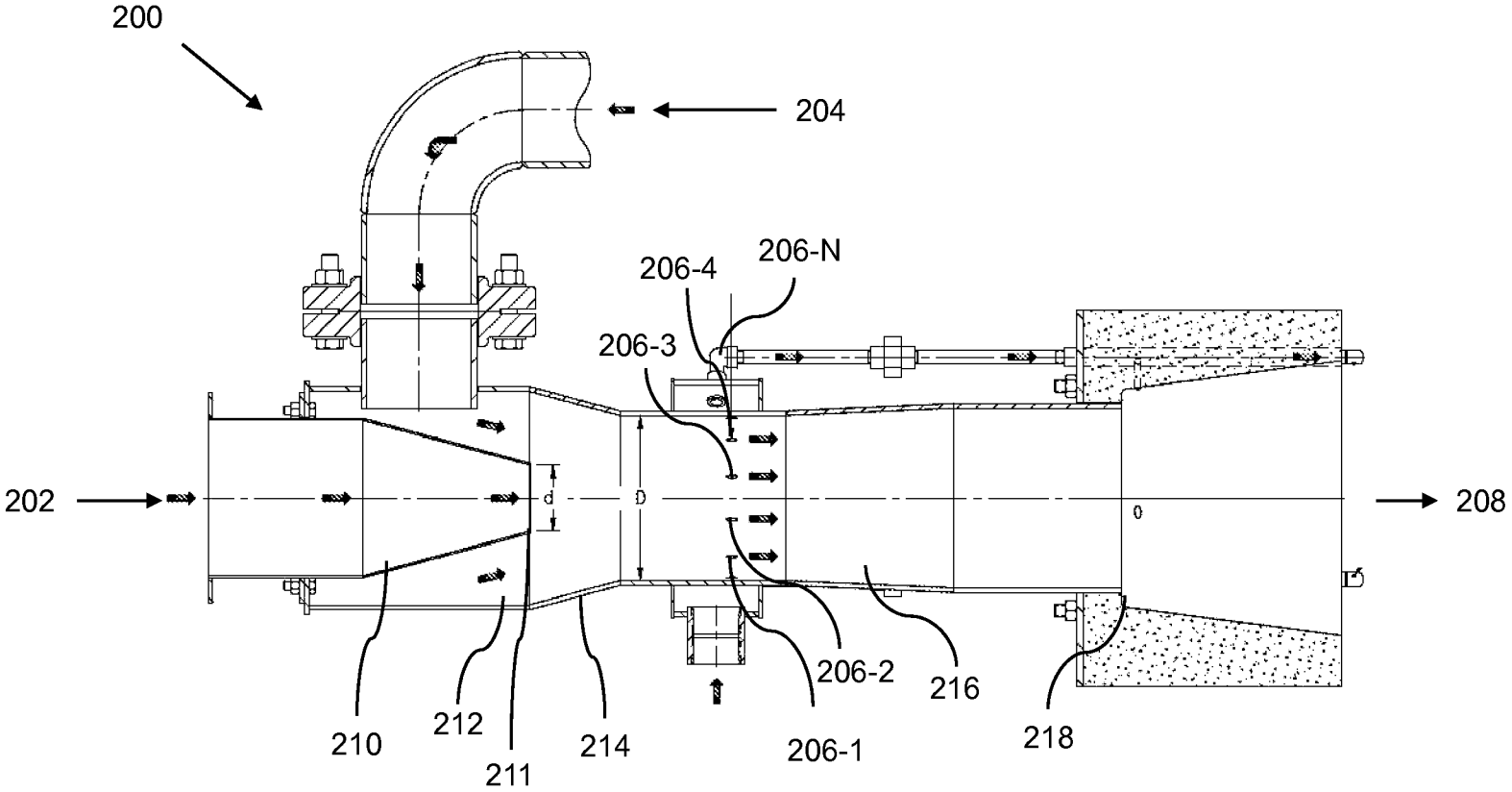
FIG. 2 is a cutaway side view of a burner with a combustion air driven jet pump according to one or more embodiments of the present disclosure.

FIG. 2 is a cutaway side view of a burner with a combustion air driven jet pump according to one or more embodiments of the present disclosure. FIG. 2 provides an example of the interior of a burner assembly (e.g., burner assembly 100 of the embodiment of FIG. 1) 200.

As in FIG. 1, in the embodiment of FIG. 2, the burner apparatus 200 includes a combustion air inlet 202. The combustion air inlet includes a chamber that has a tapering portion 210 forming an air nozzle 211 with a diameter (d) at its innermost end. As used herein, the term diameter can be a diameter of a fluid path having circular cross section or can be a measurement of a largest width of a fluid path having a non-circular cross section (e.g., oval, rectangular).

In some embodiments, the assembly can include a distribution element at or near the end of the air nozzle 211 (e.g., at or near the smallest diameter of the air nozzle). For example, a perforated plate (e.g., having a number of holes formed therein) can be provided at the narrow end of the air nozzle. This can, for instance, act to keep the flue gas more uniformly distributed in the housing 212 before it is educted by the nozzle 211. Such a mechanism can cause the flue gas to be more uniformly fed into the jet pump, which can provide a better (more uniform) mixture into the mixing tube where fuel gas is added.

Flue gas is received through a flue gas inlet 204. The flue gas enters the burner apparatus via the inlet and progresses into a flue gas receiving chamber 212, referred to herein generally as the jet pump bell, although the bell also includes tapering portion 214.

In the embodiment of FIG. 2, the flue gas and combustion air are mixed in a narrowing portion of the chamber 214 used to convey the fluids (e.g., flue gas, combustion air). However, in some embodiments, the chamber can be a constant diameter. For example, the chamber can have the diameter D (with reference to FIG. 2) for portions 212, 214, and 216.

In the embodiment of FIG. 2, fuel is added into the chamber at an upstream location in fuel mixing chamber 216 through a number of fuel inlets 206-1, 206-2, 206-3, 206-4, 206-N (referred to generally as inlets 206). These can, for example, be fuel jets or fuel ports.

The fuel and flue gas-combustion air mixture are mixed to form a fuel-flue gas-combustion air mixture in a mixing portion of the chamber 216 which has a diameter (D). The mixture is ignited and the flame and resultant flue gas exits the chamber at outlet 208. In some embodiments, the apparatus can include a flame attachment ledge 218 that allows a surface on which the fuel-flue gas-combustion air mixture can be ignited.

As discussed above, one burner apparatus includes a jet pump located inside a burner housing. In the embodiment of FIG. 2 the jet pump (e.g., elements 202, 210, and 212) has a jet pump inlet 202 that is connected to a combustion air fan (not shown) but can be provided upstream of the inlet 202 of the burner housing (elements including 210, 211, 212, 214, 216). The combustion air fan provides a volume of combustion air and combustion air pressure sufficient to drive the jet pump.

The embodiments of the present disclosure can utilize a jet pump arrangement designed and located inside the burner housing (e.g., elements 212, 214, and 216). The jet pump inlet 202 is connected to the combustion air fan, which provides the combustion air volume and pressure to drive the pump.

The jet pump bell 212, which receives air from the centrally positioned combustion air nozzle 211, creates a negative pressure condition when the combustion air fan is operating. This negative pressure, once connected to the flue gas source (e.g., exhaust stack and/or fired chamber), can be used to pull flue gas from the flue gas source without the use of an additional fan or the need to upsize the combustion air fan.

The flue gas enters the burner housing inside the jet pump bell 212. The flue gas is educted and mixed with the combustion air at chamber portion 214. The mixture then passes into the burner throat (i.e., chamber portion 216, in the embodiment of FIG. 2) where it can be mixed with fuel in various ways to provide a flame at the burner outlet 208.

For example, in some embodiments, such as the embodiment of FIG. 2, the burner throat 216 can include a number of fuel inlets 206 provided downstream from the jet pump, but on the upstream portion of the burner throat. In this way, the fuel can be dispersed and mixed in the burner throat before it is ignited.

By having the inlets arranged around the circumference of the burner throat, the fuel can be better dispersed into the flue gas-combustion air mixture passing through the burner throat. Further, if the inlets are arranged generally uniformly spaced from each other, the fuel can be more evenly disbursed.

Other advantages of arranging them around the circumference and even spacing include a shorter period needed for mixing and, therefore, potentially shorter throat portion of the chamber, mixing inwardly from the outside of the throat thereby allowing for more complete mixing than if the fuel is distributed from the center of the throat or from one position along the circumference, among other benefits.

This fuel port (inlet) arrangement also utilizes the available fuel gas pressure and fuel port velocity to increase the negative pressure created by the jet pump. This fuel port arrangement also provides a means to mix the gaseous fuel with the combustion air-flue gas mixture. This increase in negative pressure (suction) allows larger volumes of flue gas to be drawn, which improves the NOx reduction mechanism, while using smaller transport ducting (e.g., elements 204, 212, 214, 216), among other benefits.

As illustrated in FIG. 2, the burner apparatus 200 can include a combustion air inlet 202 which communicates to a frustoconical nozzle 211 centered in the jet pump bell 212. The jet pump bell 212 has a larger diameter inlet end that connects to the flue gas source 204, and tapers at 214 to a smaller diameter outlet end that connects to a mixing tube 216 which extends downstream to the burner discharge end 208.

In one example embodiment, the nozzle 211 with diameter (d) and mixing tube 216 with diameter (D) are sized and located according to the following ratios:

1) Nozzle diameter to mixing tube diameter=$0.2<d/D<0.9$

2) Distance nozzle exit to mixing tube entrance=$0.8d$–$2.0d$

The mixing tube can include a fuel gas manifold that surrounds the tube radially at some distance downstream from the entrance of the mixing tube 216. The inside wall of the manifold (also the mixing tube wall), can, for example, include a series of holes drilled radially and inward at an angle ranging from 0-90 degrees and directed downstream toward the burner exit 208. The angled nature of the holes allows the fuel to be introduced into the mixing tube in a downstream direction which can increase negative pressure and increase the amount of flue gas that can be drawn into the burner apparatus 200.

Combustion air enters the nozzle inlet 202, accelerates and ejects into the center of the jet pump bell 212. The negative pressure generated by the higher velocity combustion air ejecting into the jet pump bell draws flue gas from the flue gas source.

The mixture of flue gas and combustion air passes through the mixing tube for some distance before fuel gas is injected into the stream radially and, in some embodiments, at an angle downstream that creates an additional negative pressure to increase the overall suction that the device can provide.

The fuel gas, combustion air, and flue gas mix are carried downstream to the burner discharge end, where the mixture is initially lit by a pilot or other ignition means. The resulting flame can be stabilized indefinitely by various flame stabilization methods known to people of normal skill in the art.

For example, a stabilizing ledge 218 can be provided to provide a flame attachment surface that may assist in stabilizing the flame.

Provided below are a number of example embodiments according to the concepts of the present disclosure. For instance, in one example embodiment, a burner apparatus includes a jet pump located inside a burner housing. The jet pump has a combustion air inlet that receives combustion air, a chamber to receive the combustion air from the combustion air inlet, and a tapered portion of the chamber that tapers to an outlet having a smaller diameter than the diameter of the inlet. In this manner, combustion air is moved from a larger volume area into a smaller volume area, thereby speeding the flow of the air toward the outlet of the jet pump.

In various embodiments, at least the jet pump outlet is positioned within a jet pump bell. The fast moving air exiting the outlet of the jet pump enters the jet pump bell and a negative pressure is created. The negative pressure, within the jet pump bell, generated from the jet pump can be used to pull flue gas from one or more flue gas sources, such as an exhaust stack or fired chamber.

In some embodiments, supplemental or alternative negative pressure can be generated by a number of fuel inlets that direct fuel into the apparatus downstream from the jet pump bell. For example, the fuel inlets can be angled to inject fuel in a downstream direction (away from the jet pump bell outlet) and thereby create a negative pressure that can pull flue gas into the jet pump bell.

The burner apparatus can have a burner throat portion, as discussed above, which is located downstream from the jet pump bell. The burner throat can include a number of fuel inlets provided downstream from the jet pump bell, but on an upstream portion of the burner throat.

As discussed above, this can aid in the mixing of the fuel with the combustion air-flue gas mixture. In such embodiments, the flue gas is educted and mixed with the combustion air to provide a combustion air-flue gas mixture. This combustion air-flue gas mixture then passes into the burner throat where it is mixed with fuel to provide a flame at the burner outlet.

In some embodiments, the jet pump bell includes a tapered portion that tapers to an outlet having a smaller diameter than a maximum diameter of the jet pump bell. This structure can also aid in creating negative pressure similarly to the narrowing toward the outlet in the jet pump.

In another example embodiment, a burner apparatus includes a jet pump located inside a burner housing. The jet pump has a combustion air inlet that receives combustion air, a chamber to receive the combustion air from the combustion air inlet, and a tapered portion of the chamber that tapers to an outlet having a smaller diameter than the diameter of the inlet.

In such an embodiment, the jet pump bell can have a chamber to receive the combustion air from the jet pump and flue gas from a flue gas inlet. The combustion air and flue gas then mix to form a combustion air-flue gas mixture. In this manner, the jet pumps design allows for the combustion air to provide negative pressure to draw flue gas into the apparatus for use in the combustion process without the use of additional or upgraded fans for either the combustion air path or the flue gas path.

In various embodiments, multiple fuel inlets can be arranged around the circumference of the burner throat. This can allow for better mixing of the fuel with the combustion air-flue gas mixture. This can be especially true at the edges of the burner throat where an injector nearer to the central elongate axis of the throat may not be able to mix the fuel as well.

The inlets can be arranged generally uniformly spaced from each other. This can also allow for better mixing of the fuel with the combustion air-flue gas mixture.

In some embodiments, the fuel inlets can be provided downstream from the jet pump bell. This can be beneficial, for example, to allow for mixing of the fuel with the combustion air-flue gas mixture once those two items have been mixed.

Further, fuel inlets can provide fuel gas pressure and fuel velocity, when fuel is injected by the fuel inlets, which supplements negative pressure created by the jet pump that is present within the burner throat. This can be particularly true when the inlets are directed downstream.

Another example embodiment, provides a burner apparatus that includes a jet pump bell located inside a burner housing. The jet pump bell has a chamber therein for receiving combustion air and flue gas.

The example embodiment also includes a jet pump, located within the jet pump bell. The jet pump includes a combustion air inlet that receives combustion air from a combustion air fan, a chamber to receive the combustion air, and a tapered portion that tapers to an outlet having a smaller diameter than the diameter of the inlet. In this embodiment, the combustion air exiting the jet pump creates a negative pressure in the jet pump bell such that the negative pressure draws flue gas into the jet pump bell chamber that mixes with the combustion air.

In some embodiments, the jet pump bell includes a tapered portion that tapers to an outlet having a smaller diameter than a maximum diameter of the jet pump bell. This can be beneficial in providing the negative pressure characteristics for pulling flue gas into the jet pump bell.

In various embodiments, the outlet of the jet pump has a diameter that is smaller than the diameter of the outlet of the jet pump bell. This can also be beneficial in providing the negative pressure characteristics for pulling flue gas into the jet pump bell.

The jet pump outlet can be centrally positioned within the jet pump bell with respect to an elongate axis of the jet pump bell, in some embodiments. This can be beneficial, for example, because the flow through the apparatus can be more symmetrical and therefore mixing can be more uniform.

The embodiments of the present disclosure provide a number of different ways to induce a negative pressure to pull flue gas into an apparatus in order to create a combustion air-flue gas mixture that can be combined with fuel gas.

As used herein, "a" or "a number of" something can refer to one or more such things. For example, "a number of resources" can refer to one or more resources. Additionally, the designator "N", as used herein, particularly with respect to reference numerals in the drawings, indicates that a number of the particular feature so designated can be included with a number of embodiments of the present disclosure.

Although specific embodiments have been illustrated and described herein, those of ordinary skill in the art will appreciate that any arrangement calculated to achieve the same techniques can be substituted for the specific embodiments shown. This disclosure is intended to cover any and all adaptations or variations of various embodiments of the disclosure.

It is to be understood that the above description has been made in an illustrative fashion, and not a restrictive one.

Combination of the above embodiments, and other embodiments not specifically described herein will be apparent to those of skill in the art upon reviewing the above description.

The scope of the various embodiments of the disclosure includes any other applications in which the above elements and methods are used. Therefore, the scope of various embodiments of the disclosure should be determined with reference to the appended claims, along with the full range of equivalents to which such claims are entitled.

In the foregoing Detailed Description, various features are grouped together in example embodiments illustrated in the figures for the purpose of streamlining the disclosure. This method of disclosure is not to be interpreted as reflecting an intention that the embodiments of the disclosure require more features than are expressly recited in each claim.

Rather, as the following claims reflect, inventive subject matter lies in less than all features of a single disclosed embodiment. Thus, the following claims are hereby incorporated into the Detailed Description, with each claim standing on its own as a separate embodiment.

What is claimed:

1. A burner apparatus, comprising:

a jet pump located inside a burner housing, the jet pump having a combustion air inlet that receives combustion air, a chamber to receive the combustion air from the combustion air inlet, and a tapered portion of the chamber that tapers to an outlet having a smaller diameter than the diameter of the inlet, wherein the outlet allows the combustion air to be pumped into a mixing chamber;

a flue gas inlet connected to the mixing chamber to allow flue gas to mix with the combustion air to form a combustion air-flue gas mixture; and a fuel inlet connected to the mixing chamber to allow fuel to mix with the combustion air/flue gas mixture to form a combustion air-flue gas-fuel mixture;

wherein at least the jet pump outlet is positioned within a jet pump bell; and wherein the jet pump outlet is positioned between the flue gas inlet and the fuel inlet and wherein negative pressure, within the jet pump bell, generated from the inflow of combustion air from the combustion air outlet of the jet pump pulls flue gas from at least one of an exhaust stack or fired chamber.

2. The apparatus of claim 1, wherein further negative pressure is generated by a number of fuel inlets that direct fuel into the apparatus downstream from the jet pump bell.

3. The apparatus of claim 2, wherein the flue gas is educted and mixed with the combustion air to provide a combustion air-flue gas mixture.

4. The apparatus of claim 1, wherein the jet pump bell includes a tapered portion that tapers to an outlet having a smaller diameter than a maximum diameter of the jet pump bell and wherein the tapered portion of the jet pump bell is positioned after the outlet of the jet pump, and wherein the combustion air-flue gas mixture passes from the outlet of the jet pump bell into a burner throat where it is mixed with fuel to provide a flame at a burner outlet.

5. The apparatus of claim 1, wherein the jet pump bell includes a tapered portion that tapers to an outlet having a smaller diameter than a maximum diameter of the jet pump bell.

6. A burner apparatus, comprising:

a jet pump located inside a burner housing, the jet pump having a combustion air inlet that receives combustion air, a chamber to receive the combustion air from the combustion air inlet, and a tapered portion of the chamber that tapers to an outlet having a smaller diameter than the diameter of the inlet, wherein the outlet allows the combustion air to be pumped into a mixing chamber; and a jet pump bell having a mixing chamber having a flue gas inlet connected thereto to allow flue gas to mix with the combustion air to form a combustion air-flue gas mixture and a fuel inlet connected to the mixing chamber to allow fuel to mix with the combustion air/flue gas mixture to form a combustion air-flue gas-fuel mixture.

7. The apparatus of claim 6, wherein a burner throat located downstream from the jet pump bell includes a number of fuel inlets provided downstream from the jet pump bell, but on an upstream portion of the burner throat.

8. The apparatus of claim 7, wherein a burner throat located downstream from the jet pump bell includes a plurality of fuel inlets arranged around the circumference of the burner throat.

9. The apparatus of claim 8, wherein the inlets are arranged generally uniformly spaced from each other.

10. The apparatus of claim 6, wherein a burner throat located downstream from the jet pump bell includes a number of fuel inlets provided downstream from the jet pump bell.

11. The apparatus of claim 10, wherein the fuel inlets provide fuel gas pressure and fuel velocity, when fuel is injected by the fuel inlets, which supplements negative pressure created by the jet pump that is present within the burner throat.

12. A burner apparatus, comprising:

a jet pump bell located inside a burner housing, the jet pump bell having a mixing chamber therein for receiving combustion air and flue gas;

a jet pump, located within the jet pump bell, having a combustion air inlet that receives combustion air from a combustion air fan, a chamber to receive the combustion air, and a tapered portion that tapers to an outlet having a smaller diameter than the diameter of the inlet; and wherein the jet pump bell has a flue gas inlet connected to the mixing chamber to allow flue gas to mix with the combustion air to form a combustion air-flue gas mixture, wherein combustion air exiting the jet pump creates a negative pressure in the mixing chamber such that the negative pressure draws flue gas into the mixing chamber that mixes with the combustion air and wherein the jet pump bell includes a fuel inlet connected to the mixing chamber to allow fuel to mix with the combustion air/flue gas mixture to form a combustion air-flue gas-fuel.

13. The apparatus of claim 12, wherein the jet pump bell includes a tapered portion that tapers to an outlet having a smaller diameter than a maximum diameter of the jet pump bell.

14. The apparatus of claim 13, wherein the outlet of the jet pump has a diameter that is smaller than the diameter of the outlet of the jet pump bell.

15. The apparatus of claim 12, wherein the apparatus also includes a burner throat that is downstream from the jet pump bell.

16. The apparatus of claim 15, wherein the burner throat has a number of fuel inlets for mixing fuel into a combustion-flue gas mixture.

17. The apparatus of claim 16, wherein the number of fuel inlets are arranged to inject fuel in a downstream direction.

18. The apparatus of claim 12, wherein the jet pump outlet is centrally positioned within the jet pump bell with respect to an elongate axis of the jet pump bell.

* * * * *